US006676246B1

(12) United States Patent
Anderson et al.

(10) Patent No.: US 6,676,246 B1
(45) Date of Patent: Jan. 13, 2004

(54) HEATER CONSTRUCTION FOR MINIMUM PULSE TIME

(75) Inventors: Frank Edward Anderson, Sadieville, KY (US); Robert Wilson Cornell, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 37 days.

(21) Appl. No.: 10/300,536

(22) Filed: Nov. 20, 2002

(51) Int. Cl.[7] ..... B41J 2/05
(52) U.S. Cl. ..... 347/62; 347/63
(58) Field of Search ..... 347/20, 56, 61, 347/62, 57–59, 14, 19, 63–65

(56) References Cited

U.S. PATENT DOCUMENTS

| | | | | |
|---|---|---|---|---|
| 4,595,823 A | | 6/1986 | Sorimachi et al. | 347/203 |
| 4,719,478 A | | 1/1988 | Tachihara et al. | 347/62 |
| 4,936,952 A | | 6/1990 | Komuro | 347/63 |
| 4,968,992 A | | 11/1990 | Komuro | 347/64 |
| 5,387,460 A | | 2/1995 | Hirakata et al. | 428/212 |
| 5,580,468 A | | 12/1996 | Fujikawa et al. | 216/27 |
| 5,682,185 A | | 10/1997 | Wade et al. | 347/19 |
| 5,726,690 A | | 3/1998 | Bohorquez et al. | 347/19 |
| 5,742,307 A | | 4/1998 | Watrobski et al. | 347/62 |
| 5,831,648 A | | 11/1998 | Mitaini et al. | 347/62 |
| 6,042,221 A | | 3/2000 | Komuro | 347/62 |
| 6,139,131 A | | 10/2000 | Prasad et al. | 347/63 |
| 6,142,612 A | * | 11/2000 | Whitman | 347/63 |
| 6,227,640 B1 | | 5/2001 | Maze et al. | 347/63 |
| 6,244,682 B1 | | 6/2001 | Walker et al. | 347/14 |
| 6,315,853 B1 | | 11/2001 | Kubota et al. | 156/257 |
| 6,318,845 B1 | | 11/2001 | Mizutani | 347/57 |
| 6,331,049 B1 | | 12/2001 | Leban | 347/64 |
| 6,412,290 B1 | | 7/2002 | Matsumoto et al. | 347/58 |
| 6,491,377 B1 | * | 12/2002 | Cleland et al. | 347/62 |
| 2001/0008411 A1 | | 7/2001 | Maze et al. | 347/64 |

FOREIGN PATENT DOCUMENTS

| | | | |
|---|---|---|---|
| EP | 0 490 668 B1 | 10/1996 | B41J/2/16 |
| EP | 1 078 757 A2 | 2/2001 | B41J/2/14 |
| EP | 1 078 757 A3 | 8/2001 | B41J/2/14 |
| JP | 6320729 A2 | 11/1994 | B41J/2/05 |

* cited by examiner

*Primary Examiner*—Raquel Yvette Gordon
*Assistant Examiner*—Juanita Stephens
(74) *Attorney, Agent, or Firm*—David LaRose; Jacqueline M. Daspit

(57) ABSTRACT

A heater chip structure having heating elements operable at an energy per unit volume of from about 2.9 GJ/m$^3$ to about 4.0 GJ/m$^3$, a pulse time of less than about 0.73 microseconds, and one or more protective layers having a total thickness of less than about 7200 angstroms.

19 Claims, 3 Drawing Sheets

HEATER CONSTRUCTION FOR MINIMUM PULSE TIME

FIELD OF THE INVENTION

The invention relates to ink jet print head components and in particular to heater structures for ink jet print heads.

BACKGROUND AND SUMMARY OF THE INVENTION

Thermal ink jet printing involves providing signal impulses to resistive heaters to generate heat, and transferring the heat into adjacently disposed volumes of ink for vaporizing and ejecting the ink through nozzles. As the throughput and print quality continue to increase for ink jet printers, an increased number of ink ejection nozzles and an increased heater firing frequency are required.

Each heater is activated by applying an electrical energy pulse in an amount sufficient to eject a predetermined volume of ink. The "pulse time" is the time during which energy is applied to the heater in an amount sufficient to eject ink. The firing interval for a heater consists of the pulse time and dead time, e.g., the time before and after the pulse time when no energy or energy in an amount insufficient to eject ink is applied to the heater. For print heads having an increased number of nozzles and an increased heater firing frequency, the time available to address all nozzle hole positions in an array decreases.

Heater structures typically include heater resistors disposed on a heater chip and one or more protective layers adjacent the heater resistor. The protective layer or layers protect the heater resistors and the heater chip from cavitation and passivation, e.g., mechanical damage from fluid motions of the ink and damage from corrosive/chemical effects of the ink. However, it has been experienced that the protective layers tend to have insulating properties which increase the amount of energy that must be applied to a heater to eject ink at a stable velocity suitable for ink jet printing. The increased energy requirement correspondingly results in an increased pulse time. Also, the increased energy applied to the heater chip can cause heating related problems, such as flooding and poor print quality.

The invention relates to a heater construction that enables a reduction in the pulse time and the energy applied to the heaters, and thus achieves heater structures more suitable for providing ink jet printers having an increased number of ink ejection nozzles and an increased heater firing frequency.

The invention advantageously provides a heater chip structure having heating elements operable at an energy per unit volume of from about 2.9 $GJ/m^3$ to about 4.0 $GJ/m^3$, a pulse time of less than about 0.73 microseconds, and one or more protective layers having a total thickness of less than about 7200 angstroms.

In a preferred embodiment, the heater construction includes a heater chip including a plurality of heating elements. Each heating element includes a heating resistor placeable in electrical communication with a power supply and having an area and a thickness. A protective layer having a thickness of less than about 7200 Angstroms overlies the heating resistor.

Each heating element has a volume and is associated with a corresponding one of the plurality of nozzles, for transferring heat into adjacent ink for a period of time corresponding to a pulse time of less than about 0.73 microseconds to achieve ejection of the ink through the nozzle in response to energy being supplied to the heater resistor by the power supply.

The energy to be supplied to each of the heater resistor ranges from about 2.9 $GJ/m^3$ to about 4.0 $GJ/m^3$ based on the volume of the heating element. The volume of the heating element is determined by the area of the heater resistor multiplied by the sum of the thickness of the heater resistor and the thickness of the protective layer.

In other aspects, the invention relates to ink jet printers incorporating such heater chips, and to methods for printing by use of the heater chips. Use of the heater chips advantageously avoids problems associated with print heads having conventional heater chips, such as undesirable temperature rises and associated effects such as flooding and poor print quality.

BRIEF DESCRIPTION OF THE DRAWINGS

Further advantages of the invention will become apparent by reference to the detailed description of preferred embodiments when considered in conjunction with the drawings, wherein like reference characters designate like or similar elements throughout the several drawings as follows.

DETAILED DESCRIPTION OF THE INVENTION

Figure 1:
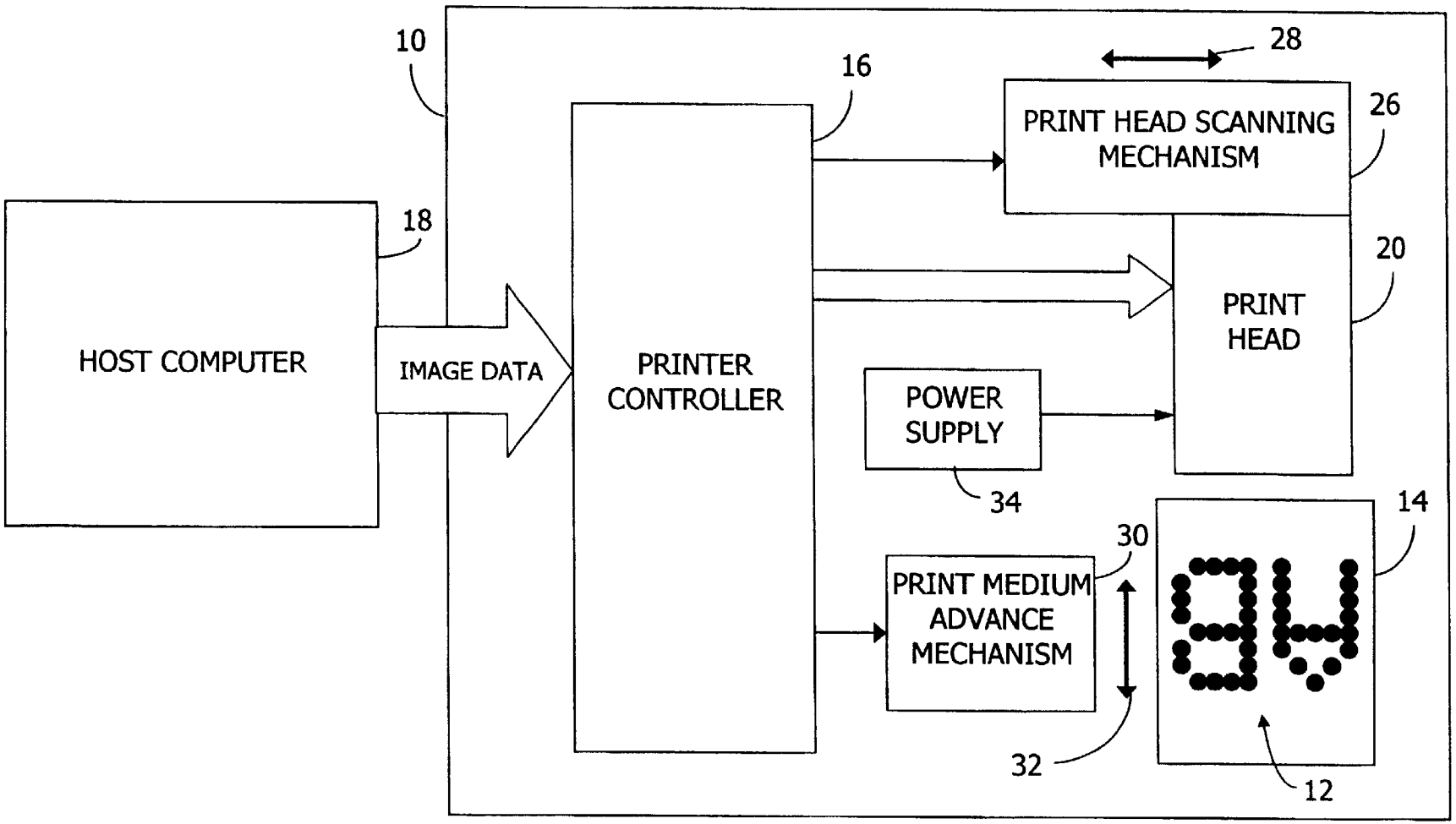
FIG. 1 is a functional block diagram of an ink jet printer according to a preferred embodiment of the invention.

In accordance with one aspect of the invention, it has been discovered that reducing the pulse time of a heater chip structure advantageously avoids problems associated with print heads having conventional heater chips, such as undesirable temperature rises and associated effects such as flooding and poor print quality.

It has further been discovered that the required pulse time for satisfactory operation of an ink jet heater is generally a function of the heater stack thickness and is generally independent of the heater area and ink composition. In this regard, the term "heater stack" will be understood to refer generally to the structure associated with the thickness of a heater chip which generally includes a semiconductor substrate having thereon one or more resistive, conductive, and protective (e.g., cavitation and passivation) layers. More specifically, it has been discovered that relatively low pulse times and improved printer performance may be achieved by constructing the heater chip to limit the thickness of the protective layers and applying only relatively low power to the resistors.

In a preferred embodiment, the invention provides a heater construction that enables a reduction in the pulse time and is more suitable for providing ink jet printers having an increased number of ink ejection nozzles and an increased heater firing frequency. Most preferably, this is achieved by use of a heater chip structure having resistors operable for their intended purpose at an energy per unit volume of from about 2.9 $GJ/m^3$ to about 4.0 $GJ/m^3$, a pulse time of less than about 0.73 microseconds, and one or more protective layers, with the total thickness of the protective layers being less than about 7200 angstroms.

The heater chip structure of the invention is preferably incorporated into a print head for use in an ink jet printer. In this regard, and with reference to FIG. 1, there is shown an ink jet printer 10 for printing an image 12 on a print medium 14. The printer 10 includes a printer controller 16, such as a digital microprocessor, that receives image data from a host computer 18. Generally, the image data generated by the host computer 18 describes the image 12 in a bit-map format.

Figure 2:
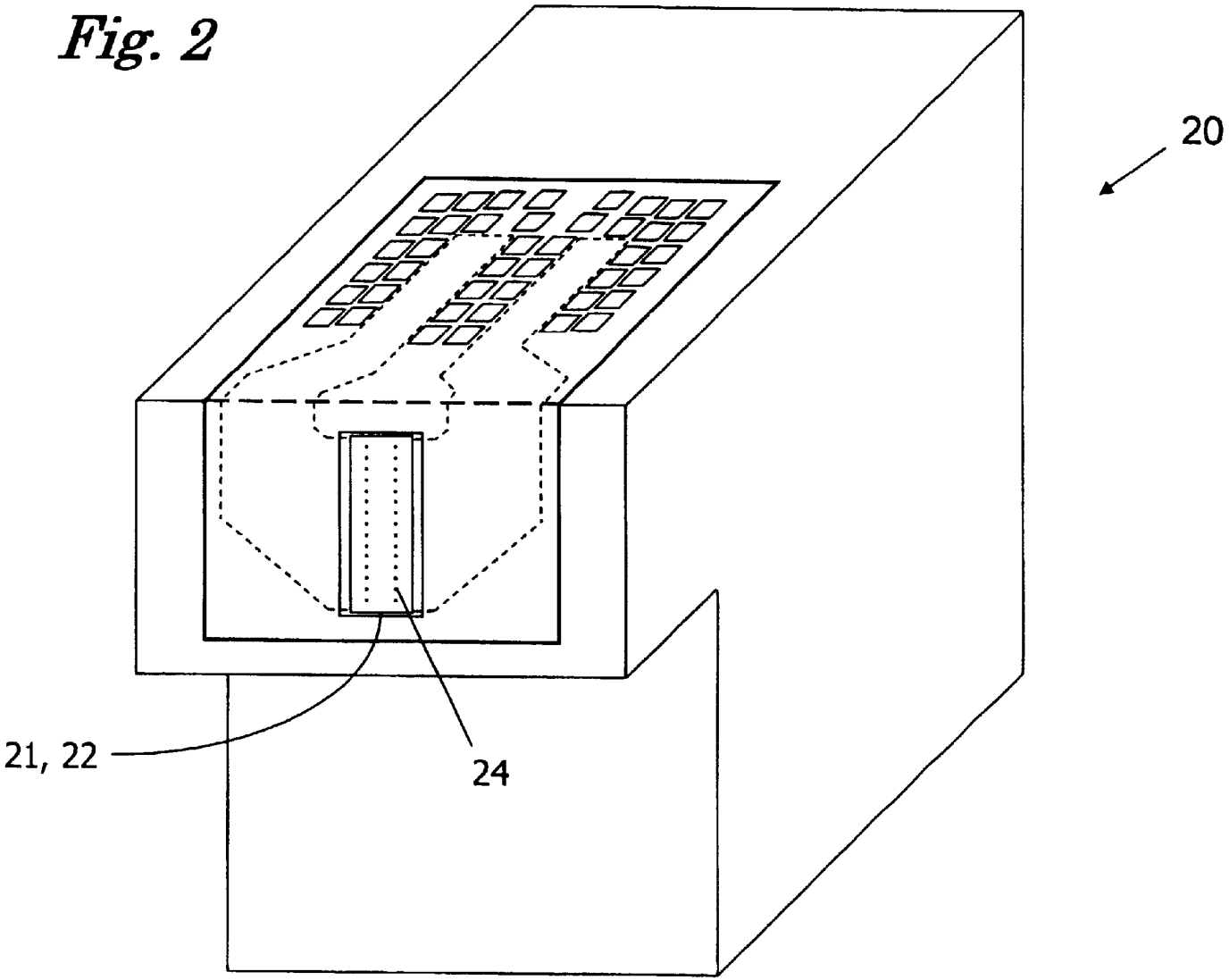
FIG. 2 is an isometric view of an ink jet print head according to a preferred embodiment of the invention.

As shown in FIGS. 1 and 2, the printer 10 includes a print head 20 that receives print signals from the printer controller 16. On the print head 20 is a thermal ink jet heater chip 21 covered by a nozzle plate 22. Within the nozzle plate 22 are nozzles 24. Based on the print signals from the printer controller 16, ink droplets are ejected from selected ones of the nozzles 24 to form dots on the print medium 14 corresponding to the image 12. As described in more detail hereinafter, ink is selectively ejected from a selected nozzle 24 when a corresponding heating element on the heater chip 21 is activated by the print signals from the controller 16. As used herein, the term "ink" will be understood to refer to both pigment and dye based printing inks.

Returning to FIG. 1, the printer 10 also preferably includes a print head scanning mechanism 26 for scanning the print head 20 across the print medium 14 in a scanning direction as indicated by the arrow 28. Preferably, the print head scanning mechanism 26 consists of a carriage which slides horizontally on one or more rails, a belt attached to the carriage, and a motor that engages the belt to cause the carriage to move along the rails. The motor is driven in response to the commands generated by the printer controller 16.

The printer 10 also includes a print medium advance mechanism 30. Based on print medium advance commands generated by the controller 16, the print medium advance mechanism 30 causes the print medium 14 to advance in a paper advance direction, as indicated by the arrow 32, between consecutive scans of the print head 20. Thus, the image 12 is formed on the print medium 14 by printing multiple adjacent swaths as the print medium 14 is advanced in the advance direction between swaths. In a preferred embodiment of the invention, the print medium advance mechanism 30 is a stepper motor rotating a platen which is in contact with the print medium 14. As shown FIG. 1, the printer 10 also includes a power supply 34 for providing a supply voltage to the print head 20 scanning mechanism 26 and print medium advance mechanism 30.

Figure 3A:
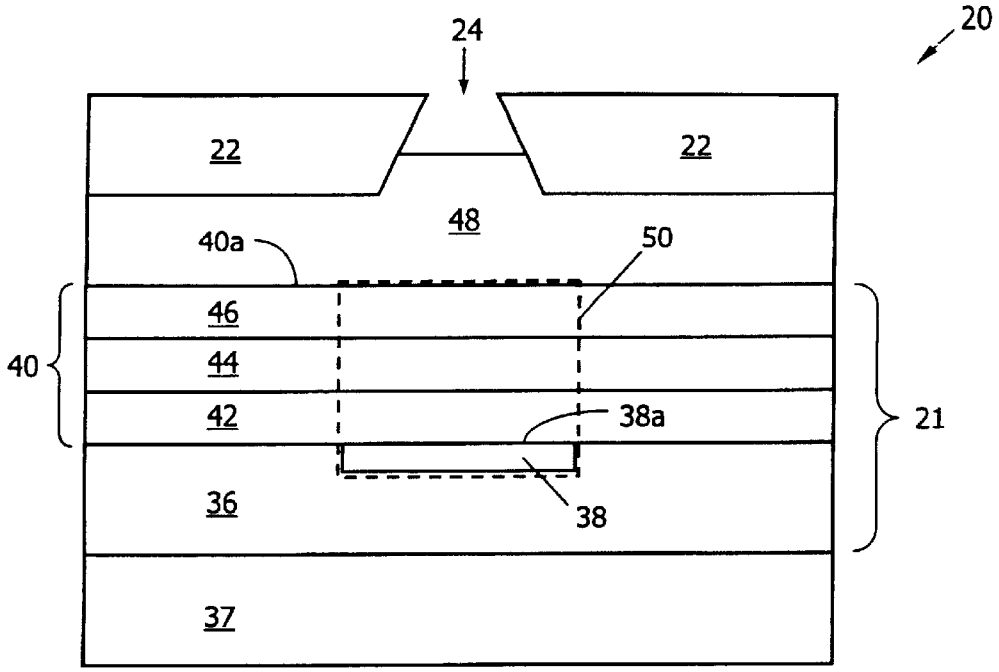
FIG. 3A is a cross-sectional view of a portion of an ink jet print head according to a preferred embodiment of the invention.

FIG. 3A depicts a cross-sectional view of a portion of the heater chip 21 and nozzle plate 22 on the print head 20. The view of FIG. 3A shows one of many heater resistors 38 on the heater chip 21 and one of the nozzles 24 of the nozzle plate 22. The heater chip 21 includes a thermal insulation layer 36 which is preferably formed from a thin layer of silicon dioxide and/or doped silicon glass overlying a relatively thick slab of silicon 37. The total thickness of the thermal insulation layer 36 is preferably from about 1 to about 3 microns thick.

In the preferred embodiment, a silicon substrate layer 37, which is preferably from about 0.5 to about 0.8 millimeters thick, underlies the thermal insulation layer 36. The heater resistor 38 is preferably formed on the thermal insulation layer 36 from an electrically resistive material, such as tantalum-aluminum, tantalum-nitride, tantalum-aluminum-nitride, or a composite material consisting of discrete layers of tantalum and tantalum-aluminum. The thickness of the heater resistor 38 is preferably from about 500 to about 1500 Angstroms.

Figure 3B:
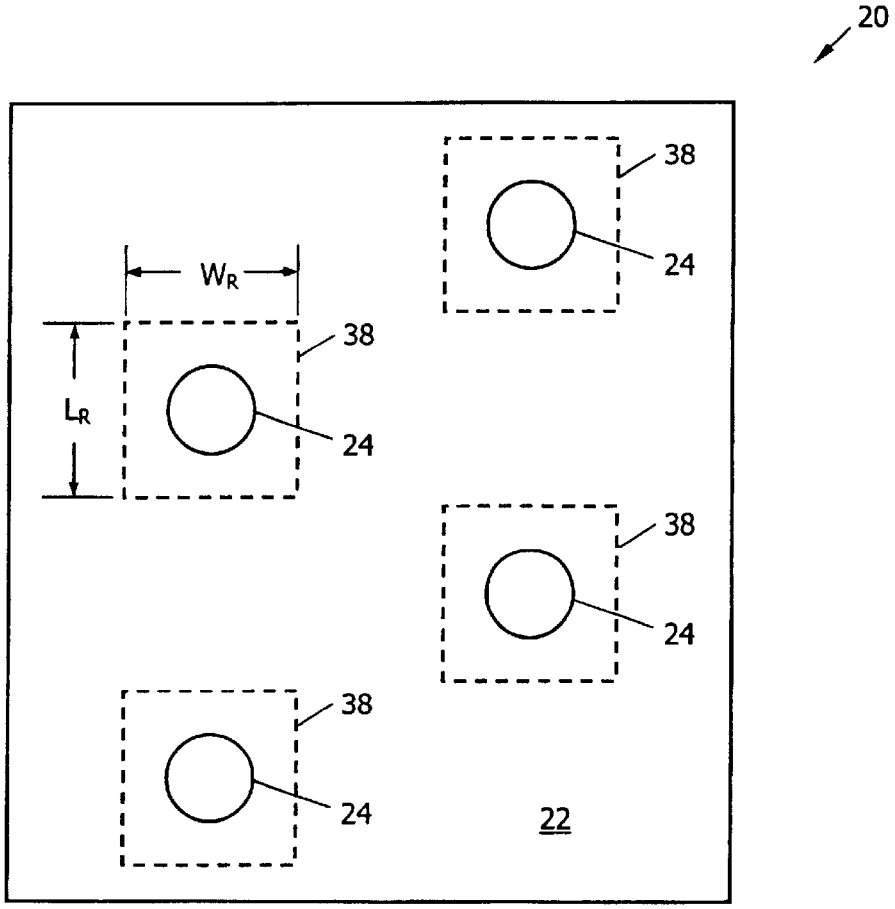
FIG. 3B is a plan view of a portion of an ink jet print head according to a preferred embodiment of the invention.

FIG. 3B shows a plan view of a portion of the heater chip 21 and the nozzle plate 22, and depicts several of the heater resistors 38 (in dashed outline) and their associated nozzles 24. As shown, each heater resistor 38 has a width $W_R$ and a length $L_R$. In a preferred embodiment, the surface area of each heater ($W_R \cdot L_R$) is preferably from about 300 to about 1100 $\mu m^2$. While the heater resistor 38 shape is generally depicted as having a square, or rectangular shape, it is understood that other shapes may be used that are not described simply by a width $W_R$ and a length $L_R$. However, the heater resistors having non-square and non-rectangular shapes also preferably each have a surface area of from about 300 to about 1100 $\mu m^2$.

Returning to FIG. 3A, a protective layer 40 overlies the heater resistor The protective layer 40 preferably is a combination of several material layers. In the preferred embodiment, the protective layer 40 includes a first passivation layer 42, a second passivation layer 44, and a cavitation layer 46.

In an alternate embodiment, the protective layer 40 consists of a first passivation layer 42, and a cavitation layer 46. There is no second passivation layer 44 between the first passivation layer 42 and the cavitation layer 46. In yet another embodiment, the protective layer 40 consists of a first passivation layer 42. There is no second passivation layer 44, nor is there a cavitation layer 46 over the first passivation layer 42. In yet another embodiment, the protective layer 40 consists of a first passivation layer 42, and a second passivation layer 44. There is no cavitation layer 46 over the second passivation layer 44.

The combination of materials in the protective layer tends to prevent the adjacent ink 48, or other contaminants, from adversely affecting the operation and electrical properties of the heater resistor 38. One skilled in the art will appreciate that many other materials and combinations of materials could be used to form the protective layer 40, some of which are discussed hereinafter. Thus, the invention is not limited to any particular material or combination of materials in the protective layer 40.

In accordance with a preferred embodiment, the first passivation layer 42 is formed from a dielectric material, such as silicon nitride, or silicon doped diamond-like carbon (Si-DLC) having a thickness of from about 1000 to about 3200 Angstroms thick. The second passivation layer 44 is also preferably a dielectric material, such as silicon carbide, silicon nitride, or silicon-doped diamond-like carbon (Si-DLC) having a thickness preferably from about 500 to about 1500 Angstroms thick.

The first and second passivation layers 42 and 44 may also be formed from a single layer of diamond-like-carbon (DLC), or silicon doped diamond-like carbon (Si-DLC), having a thickness of from about 1500 to about 4700 Angstroms thick. For the embodiments that do not include a separate cavitation layer 46, the protective layer 42 and/or 44 provides both the electrical and ink protection for the resistor 38. In such cavitation layer-less embodiments, the protective layer 40 may be made from a combination of Si-DLC and DLC, with the Si-DLC on the substrate side, and the DLC on the ink side of the protective layer 40. The combined thickness of the Si-DLC and DLC layers may be from about 1000 to about 7200 Angstroms thick.

The cavitation layer 46 is preferably formed from tantalum having a thickness greater than about 500 Angstroms thick. The maximum thickness of the cavitation layer 46 is such that the total thickness of protective layer 40 is less than 7200Angstroms thick. The cavitation layer 46 may also be made of TaB, Ti, TiW, TiN, WSi, or any other material with a similar thermal capacitance and relatively high hardness.

The thickness of the protective layer 40 is defined as the distance from the top surface 38*a* of the heater resistor 38 to the outermost surface 40*a* of the protective layer 40. In accordance with the invention, the thickness $t_P$ of the protective layer 40 is less than about 7200 Å, and most preferably from about 1000 to about 7200 Angstroms thick.

Electrical power applied to the heater resistor 38 via the power supply 34 generates heat that is transferred through the protective layer 40 and into the adjacent ink 48. In describing this heat transfer process, the heater resistor 38 and the portion of the protective layer 40 overlying the heater resistor 38 (as indicated by the dashed outline in FIG. 3A) are referred to herein as the heating element 50.

The volume of the heating element 50 is determined by the area of the heater resistor 38 multiplied by the sum of the thickness of the heater resistor 38 and the thickness of the protective layer 40. Energy is preferably supplied to each of the heating elements 50 in an amount to correspondingly yield an energy per unit volume (based on the volume of the heating element 50) of from about 2.9 $GJ/m^3$ to about 4.0 $GJ/m^3$.

It is contemplated, and will be apparent to those skilled in the art from the preceding description and the accompanying drawings, that modifications and changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. An ink jet printer for forming printed images by ejecting droplets of ink onto a print medium, the printer comprising:

a power supply; and an ink jet print head powered by the power supply and in communication with an ink supply, the print head including:

a plurality of nozzles through which the droplets of ink are ejected; and a heater chip having a plurality of heating elements, each heating element including a heating resistor in electrical communication with the power supply and having an area and a thickness, and a protective layer having a thickness of less than about 7200 Angstroms overlying the heating resistor, each heating element having a volume and associated with a corresponding one of the plurality of nozzles, for transferring heat into adjacent ink for a period of time corresponding to a pulse time of less than about 0.73 microseconds to achieve ejection of the ink through the nozzle in response to energy being supplied to the heater resistor by the power supply, wherein the energy supplied to each of the heater resistor ranges from about 2.9 $GJ/m^3$ to about 4.0 $GJ/m^3$ based on the volume of the heating element, and wherein the volume of the heating element is determined by the area of the heater resistor multiplied by the sum of the thickness of the heater resistor and the thickness of the protective layer.

2. The ink jet printer of claim 1 wherein the thickness of the heater resistor 38 ranges from about 500 to about 1500 Angstroms thick.

3. The ink jet printer of claim 1 wherein the heater resistor area is about 300 $\mu m^2$ to about 1100 $\mu m^2$ and the heater resistor thickness ranges from about 500 to about 1500 Angstroms thick.

4. The ink jet printer of claim 1 wherein the protective layer thickness is within a range of about 1000 to about 7200 Angstroms.

5. The ink jet printer of claim 1 wherein the protective layer comprises multiple layers of material.

6. The ink jet printer of claim 1 wherein the protective layer comprises one or more materials selected from the group consisting of silicon-nitride (SiN), silicon-carbide (SiC), tantalum (Ta), titanium-tungsten (TiW), diamond-like carbon (DLC), silicon doped diamond-like carbon (Si-DLC), tatalum-boride (TaB), titanium-nitride (TiN), titanium (Ti), and tungsten-silicon (WSi).

7. The ink jet printer of claim 1 wherein the heater resistor comprises one or more materials selected from the group consisting of tantalum-aluminum (TaAl), tantalum-nitride (TaN), tantalum-aluminum-nitride (TaAl:N), and composite layers of tantalum and tantalum-aluminum (Ta+TaAl).

8. A heater chip structure having heating elements operable at an energy per unit volume of from about 2.9 $GJ/m^3$ to about 4.0 $GJ/m^3$, a pulse time of less than about 0.73 microseconds, and one or more protective layers having a total thickness of less than about 7200 angstroms.

9. A heater chip for an ink jet printer, the heater chip including a plurality of heating elements, each heating element including a heating resistor placeable in electrical communication with a power supply and having an area and a thickness, and a protective layer having a thickness of less than about 7200 Angstroms overlying the heating resistor, each heating element having a volume and associated with a corresponding one of the plurality of nozzles, for transferring heat into adjacent ink for a period of time corresponding to a pulse time of less than about 0.73 microseconds to achieve ejection of the ink through the nozzle in response to energy being supplied to the heater resistor by the power supply, wherein the energy to be supplied to each of the heater resistor ranges from about 2.9 $GJ/m^3$ to about 4.0 $GJ/m^3$ based on the volume of the heating element, wherein the volume of the heating element is determined by the area of the heater resistor multiplied by the sum of the thickness of the heater resistor and the thickness of the protective layer.

10. A method for printing with an ink jet printer, comprising the steps of:

providing a power supply, providing an ink supply, providing a thermal ink jet print head in electrical communication with the power supply and in fluid communication with the ink supply, the print head having a plurality of nozzles through which the droplets of ink are ejected, and having a heater chip which includes a heater chip having a plurality of heating elements, each heating element including a heating resistor in electrical communication with the power supply and having an area and a thickness, and a protective layer having a thickness of less than about 7200 Angstroms overlying the heating resistor, each heating element having a volume and associated with a corresponding one of the plurality of nozzles, applying a pulse time of less than about 0.73 microseconds to each heating resistor to achieve ejection of the ink through the nozzle at an energy per unit volume of heating element ranging from about 2.9 $GJ/m^3$ to about 4.0 $GJ/m^3$, wherein the volume of the heating element is determined by the area of the heater resistor multiplied by the sum of the thickness of the heater resistor and the thickness of the protective layer, and ejecting droplets of ink at a stable velocity onto a print medium.

11. The heater chip structure of claim 8 wherein the one or more protective layers comprise one or more materials selected from the group consisting of silicon-nitride (SiN), silicon-carbide (SiC), tantalum (Ta), titanium-tungsten (TiW), diamond-like carbon (DLC), silicon dope diamond-like carbon (Si-DLC), tatalum-boride (TaB), titanium-nitride (TiN), titanium (Ti), and tungsten-silicon (WSi).

12. The heater chip structure of claim 8 wherein the heating elements comprise one or more materials selected from the group consisting of tantalum-aluminum (TaAl), tantalum-nitride (TaN), tantalum-aluminum-nitride (TaAl:N), and composite layers of tantalum and tantalum-aluminum (Ta+TaAl).

13. The heater chip structure of claim 8 wherein the heating elements have an area ranging from about 300 $\mu m^2$ to about 1100 $\mu m^2$ and the heating elements have a thickness ranging from about 500 to about 1500 Angstroms thick.

14. The heater chip of claim 9 wherein the protective layer comprises one or more materials selected from the group consisting of silicon-nitride (SiN), silicon-carbide (SiC), tantalum (Ta), titantium-tungsten (TiW), diamond-like carbon (DLC), silicon dope diamond-like carbon (Si-DLC), tatalum-boride (TaB), titanium-nitride (TiN), titanium (Ti), and tungsten-silicon (WSi).

15. The heater chip of claim 9 wherein each heating resistor comprises a material selected from the group consisting of tantalum-aluminum (TaAl), tantalum-nitride (TaN), tantalum-aluminum-nitride (TaAl:N), and composite layers of tantalum and tantalum-aluminum (Ta+TaAl).

16. The heater chip of claim 9 wherein the area of each heating resistor ranges from about 300 $\mu m^2$ to about 1100 $\mu m^2$ and the thickness of each heating element ranges from about 500 to about 1500 Angstroms thick.

17. The method of claim 10 further comprising applying one or more materials selected from the group consisting of silicon-nitride (SiN), silicon-carbide (SiC). tanalum (Ta), titanium-tungsten (TiW), diamond-like carbon (DLC), silicon dope diamond-like carbon (Si-DLC), tatalum-boride (TaB), titanium-nitride (TiN), titanium (Ti), and tungsten-silicon (WSi) to the heating resistor as the protective layer.

18. The method of claim 10 wherein the heating resistor of the thermal ink jet print heat comprises a material selected from the group consisting of tantalum-aluminum (TaAl), tanalum-nitride (TaN), tantalum-aluminum-nitride (TaAl:N), and composite layers of tantalum and tantalum-aluminum (Ta+TaAl).

19. The method of claim 10 wherein the thermal ink jet print head is provided with heating elements wherein the area of each heating element ranges from about 300 $\mu m^2$ to about 1100 $\mu m^2$ and the thickness of each heating element ranges from about 500 to about 1500 Angstroms thick.

* * * * *

UNITED STATES PATENT AND TRADEMARK OFFICE

CERTIFICATE OF CORRECTION

PATENT NO. : 6,676,246 B1 
DATED : January 13, 2004
INVENTOR(S) : Frank Edward Anderson et al.

It is certified that error appears in the above-identified patent and that said Letters Patent is hereby corrected as shown below:

Column 1,
Line 55, change “7200 angstroms” to -- 7200 Angstroms --.

Column 2,
Line 67, change “7200 angstroms” to -- 7200 Angstroms --.

Column 4,
Line 15, after “heater resistor” insert -- 38 --.
Line 67, change “7200Angstroms” to -- 7200 Angstroms --.

Column 5,
Line 64, delete “38” after “resistor”.
Line 66, change “is” to -- ranges from --.

Column 6,
Line 13, change “tatalum-boride” to -- tantalum boride --.
Line 18, change “(TaAl:N)” to -- (TaAlN) --
Line 24, change “7200 angstroms” to -- 7200 Angstroms --
Lines 52-53, after “includes” delete “a heater chip having”.

Column 7,
Lines 8 and 25, change “tatalum-boride” to -- tantalum boride --.
Line 14, change “(TaAl:N)” to -- (TaAlN) --.
Line 24, change “dope” to -- doped --.

Column 8,
Line 2, change “(TaAl:N)” to -- (TaAlN) --.
Line 12, change “dope” to -- doped --.
Line 12, change “tatalum-boride” to -- tantalum boride --.
Line 11, change “tanalum” to -- tantalum --.
Line 19, change “tanalum- nitride” to -- tantalum nitride --.

UNITED STATES PATENT AND TRADEMARK OFFICE

CERTIFICATE OF CORRECTION

PATENT NO. : 6,676,246 B1
DATED : January 13, 2004
INVENTOR(S) : Frank Edward Anderson et al.

It is certified that error appears in the above-identified patent and that said Letters Patent is hereby corrected as shown below:

Column 18 (cont'd),
Line 20, change "(TaAl:N)" to -- (TaAlN) --.

Signed and Sealed this

Eighth Day of June, 2004

JON W. DUDAS
*Acting Director of the United States Patent and Trademark Office*